United States Patent [19]

Johnson et al.

[11] Patent Number: 4,846,957

[45] Date of Patent: Jul. 11, 1989

[54] PRECIPITATION OF ASPHALTENE

[75] Inventors: Graham R. Johnson, Whitton; Paul R. Rutter, Richmond, both of United Kingdom

[73] Assignee: The British Petroleum Company p.l.c., London, England

[21] Appl. No.: 130,119

[22] PCT Filed: Apr. 11, 1987

[86] PCT No.: PCT/GB87/00244

§ 371 Date: Nov. 13, 1987

§ 102(e) Date: Nov. 13, 1987

[87] PCT Pub. No.: WO87/06255

PCT Pub. Date: Oct. 22, 1987

[30] Foreign Application Priority Data

Apr. 11, 1986 [GB] United Kingdom ..... 8608874

[51] Int. Cl.[4] ..... C10C 3/00; C10C 3/08

[52] U.S. Cl. ..... 208/86; 208/90; 208/40; 208/44; 208/45; 208/309; 208/179; 208/180

[58] Field of Search ..... 208/86, 90, 40, 44, 208/45, 309, 179, 180

[56] References Cited

U.S. PATENT DOCUMENTS

| | | | |
|---|---|---|---|
| 2,086,487 | 7/1937 | Bahlke et al. | 208/309 |
| 2,800,427 | 7/1957 | Junk, Jr. et al. | 208/90 |
| 2,847,353 | 8/1958 | Beavon | 208/309 |
| 3,003,947 | 10/1961 | Garwin | 208/309 |
| 3,321,394 | 5/1987 | Mills | 208/309 |
| 4,447,269 | 5/1984 | Schreuders et al. | 208/44 |
| 4,623,395 | 11/1986 | Goodrich | 208/40 |
| 4,686,028 | 8/1987 | Van Driesen et al. | 208/309 |

FOREIGN PATENT DOCUMENTS

| | | | |
|---|---|---|---|
| 3307373 | 4/1984 | Fed. Rep. of Germany | 208/309 |
| 0027985 | 2/1984 | Japan | 208/309 |
| 503886 | 4/1939 | United Kingdom | 208/309 |
| 760314 | 10/1956 | United Kingdom | 208/309 |

*Primary Examiner*—H. M. S. Sneed
*Assistant Examiner*—Chung K. Pak
*Attorney, Agent, or Firm*—Morgan & Finnegan

[57] ABSTRACT

Asphaltenes are separated from hydrocarbon oil by bringing the oil into contact with formic acid or a water-soluble organic acid consisting of carbon, hydrogen and oxygen and having at least two functional groups.

12 Claims, No Drawings

PRECIPITATION OF ASPHALTENE

The present invention relates to the separation of asphaltenes from oil.

The asphaltenes content of a petroleum product is the percentage by weight of wax-free material insoluble in n-heptane but soluble in hot benzene.

U.S. Pat. No. 3,321,394 discloses a process for separating asphalt and asphaltenes from hydrocarbon oils in which the oil is brought into contact with a solvent which may be a normal or isoparaffin having from 5 to 7 carbon atoms in the molecule to precipitate asphaltenes.

The solvent extraction process produces a mixture of precipitated asphaltenes and solvent. The mixture is then withdrawn from contact with the hydrocarbon oil originally containing the asphaltenes. It is then necessary to separate the asphaltenes from the liquid used to cause its separation. One method by which this may be done is by allowing the asphaltenes to settle by gravity. However we have found that the rate of sedimentation of the asphaltenes from the higher molecular weight solvents, e.g. $C_5$–$C_7$ hydrocarbons is undesirably slow.

It will be desirable to find an improved method for separating asphaltenes from oils containing them.

According to the present invention the process for the separation of solid asphaltenes from hydrocarbon oil containing asphaltenes wherein the oil is brought into contact with an acid is characterised in that the acid is formic acid or a water soluble organic acid consisting of carbon hydrogen and oxygen and having at least two functional groups.

The preferred acid is formic acid. It has a low molecular weight and is therefore effective at low dosages. It is liquid over a range of temperatures useful for precipitating asphaltenes, but boils at a relatively low temperature (101° C.) at atmospheric pressure so facilitating the use and recovery of the pure acid. Asphaltene precipitation can also be facilitated by a selected group of other organic acids namely those acids which are water-soluble, contain only carbon, hydrogen, and oxygen and which have a second functional group. The acidity of the acid may be due to a carboxyl group or a phenolic group. The second functional group may be a second carboxyl group or may be an aliphatic hydroxyl or phenolic group. Thus examples of acids which may be used are alkane dicarboxylic acids such as oxalic, malonic, succinic and glutaric, hydroxy alkane dicarboxylic acids e.g. citric acid, and phenols containing more than one phenolic group e.g. resorcinol. An extensive list of compounds identified as water soluble at room temperature is given in the table of physical constants of organic compounds in Handbook of Chemistry and Physics published by the Chemical Rubber Company (65th Edition). The acid is preferably substantially insoluble in heptane at 20° C.

The acid must be brought into contact with the oil. Where the acid is not liquid at the temperature of the asphaltene precipitation step it may be necessary to use it as a solution. The solvent is preferably a relatively low boiling organic liquid e.g. methanol or acetone.

The introduction of excessive amounts of water with the acid is preferably avoided. Thus if aqueous formic acid is used as the acid, the formic acid concentration is preferably at least 50% wt/wt, more preferably at least 90% wt/wt. In order to provide adequate contact between the oil and the acid agitation is used. Excessive agitation, however, is undesirable as this may cause the precipitated asphaltene particles to break up. This will make it more difficult to separate them from the oil.

The viscosity of crude and residual oils tends to be very high. If the viscosity is very high it may be very difficult to separate the precipitated asphaltenes from the oil, particularly when the asphaltenes concentration is high (more than 10% wt/wt). The viscosity decreases as the temperature is increased and it is therefore often convenient to carry out the deasphalting step at moderately elevated temperatures e.g. 60°–90° C.

The viscosity of the oil may be reduced by the addition of a low viscosity miscible liquid diluent. This will enhance the sedimentation rate and/or improve the filterability of the asphaltenes. The viscosity of the diluent is preferably less than 50 mPa.s, more preferably less than 20 mPa.s, at 20° C. An example of a suitable diluent is vacuum gas oil, which is a low cost distillate fraction. This has the advantage that it can remain with the deasphalted oil for downstream processing and does not have to be recycled.

Instead of being merely a diluent the added liquid may be one in which asphaltenes are insoluble.

Examples of such liquids are the normal and isoparaffins having 5 to 7 carbon atoms in the molecule.

The quantity of diluent added may vary over a moderately wide range for example the volume ratio of diluent to oil may be 0.5:1 to 4:1. The hydrocarbon oils used in the present invention are those containing precipitable asphaltenes. Preferably the quantity of asphaltenes present in the oil is at least 4% wt/wt. The oil may be a crude oil. It is preferably a residual oil, more preferably an oil which has been subjected to elevated temperatures, e.g. temperatures between 440° and 495° C., to change its properties. Thus the oil may be a visbreaker residue or may be th product of slurry phase hydrocracking of a heavy oil.

It is believed that it may be advantageous to apply the invention to oils with xylene equivalents (as hereinafter defined) greater than 40.

The precipitated asphaltenes may be separated from the oil by any convenient method e.g. sedimentation of filtration. Separation may be assisted by centrifugation.

The invention will now be illustrated with reference to the following Examples.

Some of the oils used in the examples have been characterised by their xylene equivalents (XE). In this test a sample of oil is refluxed with a large excess of solvent, consisting of a mixture of xylene and heptane. A drop of this mixture is placed on a filter paper to see whether precipitation has occurred. This test is repeated until two solvent mixtures, differing by 5% volume xylene, are found, one in which precipitation occurs and one in which it does not. Thus, an oil with a xylene equivalent (XE) of 66/70 is one in which the asphaltenes will precipitate in a solvent mixture containing 65% xylene at 35% heptane, but remain dissolved in a mixture containing 70% xylene and 30% heptane.

Alternatively two solutions differing by 2.5% volume of xylene are found in which precipitation occurs with one but not the other. In this case only the lower value is quoted.

EXAMPLE 1

2% by weight of formic acid (90% wt/wt as supplied by BDH) was added with stirring to hot (80° C.) visbreaker residue fuel (from BP Ruhr refinery) oil having a xylene equivalent (XE) of 66/70.

The mixture was allowed to stand for 12 hours before decanting a liquid supernatant from a viscous layer remaining in the beaker. These two materials were analysed for asphaltenes by precipitation at room temperature with heptane. This showed that the supernatant (76% w/w) contained 7% asphaltene material by weight. The viscous residue (24% w/w) contained 35% asphaltenes by weight. Iatroscan analysis show the asphaltene material precipitated with formic acid was indistinguishable from heptane precipitated asphaltenes.

Comparative Test A

This is a comparative example not according to the invention.

Hot (80° C.) visbreaker residue of XE 66/70 was diluted with vacuum gas oil, also at 80° C., to give a total liquid mass of 800 g of a mixture containing 37 1/2% wt of visbreaker residue. This was transferred to a 11 heated steel vessel which was stirred at 1500 rpm whilst the temperature was maintained at 80° C. After 10 minutes about 20 ml of slurry was withdrawn from the base of the vessel into a weighed centrifuge tube. This was then reweighed so as to determined the quantity of slurry removed. The quantity of precipitated asphaltene in the tube was then determined by centrifuging at 2000 rpm for 1 hour. The supernatant liquid was then decanted and the residual solid plug washed twice with cold heptane. After each wash the asphaltene/heptane slurry was centrifuged for ½ hour at 2000 rpm. After decanting the second washings the tube was dried in an oven at 100° C. for 3 hours. The tubes were then left to cool and reweighed. The result was calculated on a vacuum gas oil free basis, and is shown in Table 1.

EXAMPLE 2

After the sample had been removed in Comparative Test A a 1 ml sample of formic acid (90% wt supplied by BDH) was added to the contents of the vessel while maintaining the agitation and temperature conditions as before. Further 1 ml portions of formic acid were added at 10 minute intervals and a sample of slurry was withdrawn just before each addition as indicated above. The asphaltenes precipitated were determined as in Comparative Test A. The results are given in Table 1.

Comparative Test B

This is a comparative test not according to the invention.

An experiment was carried out as in Comparative Test A but using a mixture containing 50% wt/wt of visbreaker residue. The quantity of asphaltenes precipitated was determined as in Test A. The result is given in Table 2.

EXAMPLE 3

Portions of formic acid were added to the mixture of Test B as in Example 2. The results are given in Table 2.

Comparative Test C

This is a comparative test not according to the invention.

Comparative Test A was repeated but using a mixture with a vis-breaker residue content of 62 1/2% wt/wt. The result is given in Table 3.

EXAMPLE 4

Formic acid addition was carried out with the mixture of Test C following the procedure described in Example 2. The results are given in Table 3.

Comparative Test D

This is a comparative test not according to the invention.

Comparative Test A was repeated using a mixture with a 75% wt/wt content of visbreaker residue. The result is given in Table 4.

EXAMPLE 5

Formic acid additions were made as in Example 2 to the mixture of Test D. The results are given in Table 4.

TABLE 1

| | 37½% wt Visbreaker Residue (VR) | |
|---|---|---|
| Experiment | Formic Acid Dosage (% wt on VR) | Asphaltenes Precipitated (% wt on VR) |
| A | 0.0 | 5.6 |
| 2 | 0.4 | 10.5 |
| | 0.8 | 13.8 |
| | 1.3 | 20.8 |
| | 1.8 | 14.4 |
| | 2.8 | 18.7 |
| | 3.9 | 18.1 |
| | 5.0 | 16.8 |
| | 7.8 | 16.7 |
| | 10.7 | 17.0 |

TABLE 2

| | 50% wt Visbreaker Residue | |
|---|---|---|
| Experiment | Formic Acid Dosage (% wt on VR) | Asphaltenes Precipitated (% wt on VR) |
| B | 0.0 | 2.1 |
| 3 | 0.2 | 3.2 |
| | 0.3 | 4.0 |
| | 0.5 | 5.3 |
| | 0.7 | 5.7 |
| | 1.0 | 7.6 |
| | 1.4 | 9.6 |
| | 2.2 | 13.1 |

TABLE 3

| | 62½% wt Visbreaker Residue | |
|---|---|---|
| Experiment | Formic Acid Dosage (% wt on VR) | Asphaltenes Precipitated (% wt on VR) |
| C | 0.0 | 5.6 |
| 4 | 0.3 | 3.8 |
| | 0.5 | 4.7 |
| | 0.8 | 5.7 |
| | 1.1 | 6.9 |
| | 1.7 | 12.9 |
| | 2.3 | 17.9 |
| | 2.9 | 17.1 |

TABLE 4

| | Slurry Content 75% wt Visbreaker Residue | |
|---|---|---|
| Experiment | Formic Acid Dosage (% wt on VR) | Asphaltenes Precipitated (% wt on VR) |
| D | 0.0 | 2.1 |
| 5 | 0.2 | 2.7 |
| | 0.4 | 3.4 |
| | 0.7 | 3.6 |
| | 0.9 | 3.5 |
| | 1.5 | 5.1 |
| | 2.0 | 8.6 |

TABLE 4-continued

| Slurry Content 75% wt Visbreaker Residue | | |
|---|---|---|
| Experiment | Formic Acid Dosage (% wt on VR) | Asphaltenes Precipitated (% wt on VR) |
| | 2.7 | 15.6 |

Comparative Test E

An experiment was carried out as in Test A except that the visbreaker residue was obtained from Lavera refinery, France the vacuum gas oil was produced by the O. J. Schindler refinery, Germany and the proportion of visbreaker residue was 25% by weight. The result is shown in Table 5.

EXAMPLE 6

An experiment was carried out as in Example 2 but using the mixture of Test E. The results are shown in Table 5.

Comparative Test F

This is a comparative test not according to the invention. An experiment was carried out as in Test E and Example 6, except that the acid added to the oil mixture was glacial acetic acid. The results are shown in Table 6.

A comparison of the results for Example 6 with those for Test A shows that acetic acid is clearly not effective for precipitating asphaltenes. The strength of acetic acid as measured by pKa is not significantly different from that of formic acid. Surprisingly, however, formic acid is an effective precipitating agent and acetic acid is not.

Comparative Test G

This is a comparative test not according to the invention. An experiment was carried out as in Test F, except that concentrated sulphuric acid was added instead of acetic acid. The results are shown in Table 7.

It will be seen from comparing the results for Test G with those for Example 7 that the use of sulphuric acid caused a steady increase in the amount of precipitated material. The asphaltenes content of the visbreaker residue used in Example 5 and Test G was 16.6% as determined by the method of IP143. Clearly the use of sulphuric acid can easily lead to precipitation of materials other than asphaltenes.

Materials precipitated by sulphuric acid were found to have higher sulphur contents and very much higher oxygen contents than material precipitated by the same weight % of formic acid. The carbon, hydrogen, nitrogen, and sulphur contents of the material precipitated by formic acid were found to be very similar to asphaltenes precipitated by heptane by the method of IP 143.

TABLE 5

| Effect of Formic Acid Addition on Asphaltene Precipitation | |
|---|---|
| Formic Acid Dosage (% wt on VR) | Material Precipitated (% wt on VR) |
| 0.0 | 0.6 |
| 0.6 | 6.4 |
| 1.3 | 10.4 |
| 1.9 | 13.2 |
| 2.6 | 13.4 |
| 3.8 | 14.6 |
| 5.1 | 15.0 |
| 6.4 | 15.5 |

TABLE 5-continued

| Effect of Formic Acid Addition on Asphaltene Precipitation | |
|---|---|
| Formic Acid Dosage (% wt on VR) | Material Precipitated (% wt on VR) |
| 9.5 | 16.1 |
| 12.4 | 16.2 |

VR = visbreaker residue

TABLE 6

| Effect of Acetic Acid Addition on Asphaltene Precipitation | |
|---|---|
| Formic Acid Dosage (% wt on VR) | Material Precipitated (% wt on VR) |
| 0.0 | 1.6 |
| 0.5 | 1.7 |
| 1.1 | 1.8 |
| 1.6 | 2.0 |
| 2.1 | 1.9 |
| 3.1 | 2.1 |
| 4.2 | 2.4 |
| 5.2 | 2.7 |
| 6.3 | 2.6 |
| 7.3 | 2.7 |

VR = visbreaker residue

TABLE 7

| Effect of Sulphuric Acid Dosage on Asphaltene Precipitation | |
|---|---|
| Sulphuric Acid Dosage (% wt on VR) | Material Precipitated (% wt on VR) |
| 0.0 | 0.8 |
| 0.5 | 9.8 |
| 1.0 | 14.1 |
| 1.9 | 29.3 |
| 3.0 | 34.9 |
| 4.0 | 36.4 |
| 6.1 | 43.7 |
| 8.4 | 52.5 |
| 10.7 | 51.1 |
| 16.3 | 65.9 |

VR = visbreaker residue

Comparative Test H

An experiment was carried out using an asphaltene-containing oil produced by hydrocracking a heavy oil in a slurry of catalyst particles. This oil had the following characteristics:

| | |
|---|---|
| Density at 15° C. | 1019 kg $m^{-3}$ |
| Particulates | 3.5% wt |
| Asphaltenes (IP 143) | 8.7% wt |
| Its distillation characteristics were | |
| Initial boiling point | 250° C. |
| Recovered at 350° C. | 3.6% wt |
| Recovered at 530° C. | 56.9% wt |

200 g of the oil were mixed with 200 g of xylene and placed in a 1 l vessel and agitated at 1500 rpm while being maintained at 75° C. A 10 ml sample was taken just before the expiry of 5 minutes agitation and was tested in Comparative Test A. The result is given in Table 8.

EXAMPLE 7

After the sample had been taken in Test H a 5 ml aliquot of a 14.2% wt solution of succinic acid in methanol was added. Further aliquots were added at 5 minutes intervals with samples being taken just before each addition. The quantity of asphaltenes precipitated were determined as in Comparative Test A with the additional stage of a methanol wash following the second heptane wash. This was done so as to remove any precipitated acid from the asphaltenes. The results as shown in Table 8.

Comparative Test I

An experiment was carried out as in Test H but using a 34.7% wt solution of malonic acid in methanol.

The result is shown in Table 9.

EXAMPLE 8

After the sample had been taken in Test I 5 ml aliquots of a 34.7% wt/wt solution of malonic acid in methanol was added at 5 minutes intervals with samples being taken as in Test A. The results are shown in Table 9.

Comparative Test 5 and Example 9

An experiment was carried out as in Test H and Example 7 Except that the acid added was a 56% wt/wt solution of citric acid in methanol. The results are shown in Table 10.

Comparative test K and Example 11

Experiment were carried out as in Test H and Example 7 except that the acid was a 33.8% wt/wt solution of glutaric acid is methanol. The results are shown in Table 11.

Comparative Test L and Example 12

An experiment was carried out a in Comparative Test H and Example 7 except that the material added was a 39.2% wt/wt solution of resorcinal in methanol. The results are shown in Table 12.

TABLE 8

| Experiment | Additive % wt on oil | Precipitate % wt on oil |
|---|---|---|
| H | 0.00 | 2.05 |
| 7 | 0.33 | 5.38 |
| | 0.69 | 6.12 |
| | 1.07 | 6.62 |
| | 1.50 | 6.64 |
| | 1.97 | 9.87 |

TABLE 9

| Experiment | Additive % wt on oil | Precipitate % wt on oil |
|---|---|---|
| I | 0.00 | 1.91 |
| 8 | 0.89 | 5.57 |
| | 1.88 | 6.63 |
| | 2.94 | 6.57 |
| | 4.10 | 6.60 |
| | 5.39 | 6.33 |

TABLE 10

| Experiment | Additive % wt on oil | Precipitate % wt on oil |
|---|---|---|
| J | 0.00 | 1.28 |
| 9 | 1.38 | 5.78 |
| | 2.89 | 6.90 |
| | 4.54 | 7.49 |
| | 6.40 | 5.99 |
| | 8.43 | 8.60 |

TABLE 11

| Experiment | Additive % wt on oil | Precipitate % wt on oil |
|---|---|---|
| K | 0.00 | 1.87 |
| 10 | 0.81 | 5.80 |
| | 1.67 | 6.22 |
| | 2.63 | 6.17 |
| | 3.67 | 6.28 |
| | 4.85 | 6.32 |

TABLE 12

| Experiment | Additive % wt on oil | Precipitate % wt on oil |
|---|---|---|
| L | 0.00 | 3.71 |
| 11 | 0.95 | 7.08 |
| | 1.98 | 6.94 |
| | 3.10 | 6.96 |
| | 4.33 | 6.86 |
| | 5.71 | 4.98 |

EXAMPLES 13-24

These examples were carried out to show the application of the invention to a variety of hydrocarbon oils. The oils were mixed with vacuum gas oil or xylene. The mixture was maintained at a temperature of 80° C. while being agitated.

Formic acid (95% wt/wt) was added in small aliquots with samples of slurry taken prior to each addition as in previous experiments. The maximum precipitate obtained from each oil and the oil used are given in Table 13.

The oils used and the results obtained are shown in Table 13. In this table VBR means visbreaker residue, SPHP means slurry phase hydrogenation product, AR means atmospheric residue, F.O means fuel, and C.O means crude oil. XE means xylene equivalent. VGO is vacuum gas oil. SPHP 2 corresponds to the oil used in Test H to L and Examples 7 and 12. $SPHP_1$ is a different sample of a similar type of oil.

TABLE 13

| Ex | Oil | X.E. | Asphaltenes % wt (1) | Precipitated by Formic Acid wt % | Volume ratio oil:diluent |
|---|---|---|---|---|---|
| | Ruhr VBR | 66/70 | 16.6 | 13.1 | 1:1 VGO |
| | Lavera VBR | 66/70 | 16.6 | 16.2 | 3:1 VGO |
| | SPHP1 | 100 | 10.9 | 18.2 | 1:1 VGO |
| | | | (+3.4 solids) | 13.2 | 3:1 VGO |
| | SPHP2 | 100 | 8.7 | 7.9 | 1:1 xylene |
| | | | (+3.5% solids) | | |
| | Ahwaz Bang AR | 42.5 | 10.0 | 8.8 | 1:1 VGO |
| | Chinese FO | 0 | 0.11 | 0.25 | 1:1 VGO |
| | Grangemouth FO | 17.5 | 3.0 | 1.8 | 1:1 VGO |
| | Buchan AR | 17.5 | 4.7 | 1.1 | 1:1 VGO |
| | Rotterdam VBR | 62.5 | 12.2 | 12.1 | 1:1 VGO |

TABLE 13-continued

| Ex Oil | X.E. | Asphaltenes % wt (1) | Precipitated by Formic Acid wt % | Volume ratio oil:diluent |
|---|---|---|---|---|
| Combi Cracker Tar | | | 22 | 1:1 VGO |
| Cerro Negro C.O. | 20.0 | 10.1 | 3.0 | 1:1 VGO |

(1) determined by IP 143

Comparative Test M 200 g of hot (80° C.) visbreaker residue (ex Ruhr refinery) was mixed with 600 g of hot (80° C.) heptane and the mixture transferred to the 1 litre heated mixing vessel used for previous experiments. Stirring was carried out from 15 minutes at 1500 rpm. Stirring was then stopped and a 10 ml sample of the liquid were removed via a fixed tube inserted through the top plate of the pot and penetrating 70 mm below the liquid surface. Further samples were taken at various time intervals. These samples were all analysed for asphaltene concentration as in Comparative Test A.

From the dimensions of the pot and the amount of material remaining in it, the height of the liquid surface above the sample probe (initially 70 mm) was calculated. This height, in mm, was divided by the time in seconds, after stirring was stopped, that each sample was taken. This figure gave the sedimentation velocity of an asphaltene particle that was initially at liquid surface when stirring was stopped, but that had sedimented to the level of the sample probe when the sample was taken. Once these particles had sedimented past the level of the probe the concentration of asphaltenes in the sample withdrawn through it would fall considerably. As the concentration of asphaltenes in a sample never falls to 0% the time of the first sample with a concentration below one tenth of its original value was taken as indicating the asphaltene sedimentation velocity. The results are given in Table 14. From Table 14 it can be seen that this velocity was 0.053 mm $s^{-1}$.

TABLE 14

| Time (min) | Height of Liquid (mm) | Sedimentation Velocity ($mms^{-1}$) | Asphaltene Concentration (% wt on oil) |
|---|---|---|---|
| 0 | 70.0 | — | 11.4 |
| 4 | 68.7 | 0.29 | 12.1 |
| 8 | 67.4 | 0.14 | 12.7 |
| 12 | 66.2 | 0.092 | 9.9 |
| 16 | 64.9 | 0.067 | 2.9 |
| 20 | 63.6 | 0.053 | 0.1 |
| 25 | 62.4 | 0.042 | 0.3 |
| 30 | 61.1 | 0.034 | 0.3 |
| 50 | 58.6 | 0.020 | 0.3 |

EXAMPLES 25-27

Three further experiments were carried out as in Comparative Test M except that a small quantity of formic acid (90% wt as supplied by BDH) was added 5 minutes before stirring was stopped. The critical asphaltene sedimentation velocity for these experiments is shown in Table 15.

TABLE 15

| Experiment | Formic Acid Concentration (% wt on oil) | Critical Asphaltene Sedimentation Velocity (mm $s^{-1}$) |
|---|---|---|
| M | 0 | 0.053 |
| 25 | 1.2 | 0.14 |
| 26 | 3.0 | 0.28 |
| 27 | 6.0 | 0.28 |

A comparison of Test M with Examples 25-27 shows that even where an alphaltene-precipitating solvent is used (heptane), the rate of sedimentation of the asphaltenes is increased by the addition of acid in accordance with the invention.

Even if the total amount of asphaltene precipitated is not increased, it is clearly desirable to have an increased rate of sedimentation so that separation can be carried out more rapidly.

We claim:

1. The process for the separation of solid asphaltenes from a hydrocarbon oil containing asphaltenes wherein the oil is brought into contact with 0.6 to 12.4% by weight of formic acid.

2. A process according to claim 1 wherein the acid is added to the oil as a solution in a solvent.

3. A process according to claim 1 wherein the hydrocarbon oil is a residue which has been subjected to elevated temperatures to change its properties.

4. A process according to claim 3 wherein the elevated temperature is in the range 440° to 496° C.

5. A process according to claim 1 wherein the hydrocarbon oil is a vis-breaker residue.

6. A process according to claim 1 wherein the oil is mixed with a low viscosity diluent.

7. A process according to claim 6 wherein the diluent is an asphaltene precipitating solvent.

8. A process according to claim 7 wherein the diluent is a paraffin with between 5 and 7 carbon atoms in the molecule.

9. A process according to claim 6 wherein the diluent is a hydrocarbon distillate.

10. A process according to claim 6 wherein the diluent is a vacuum gas oil.

11. A process according to claim 7 wherein the ratio of said asphaltene-precipitating solvent to said hydrocarbon oil added is in the range 0.5:1 to 4:1.

12. The process according to claim 1 wherein the acid is an aqueous solution with a concentration not less than 50% wt/wt.

* * * * *

UNITED STATES PATENT AND TRADEMARK OFFICE

CERTIFICATE OF CORRECTION

PATENT NO. : 4,846,957

DATED : July 11, 1989

INVENTOR(S) : GRAHAM R. JOHNSON AND PAUL R. RUTTER

It is certified that error appears in the above-identified patent and that said Letters Patent is hereby corrected as shown below:

Column 2, line 36 "th" should read --the--.

Claim 4, line 41, "496°C" should read --495°C--.

Signed and Sealed this

Twenty-second Day of May, 1990

*Attest:*

HARRY F. MANBECK, JR.

*Attesting Officer*

*Commissioner of Patents and Trademarks*